US010391761B2

(12) United States Patent
Du Buf et al.

(10) Patent No.: US 10,391,761 B2
(45) Date of Patent: Aug. 27, 2019

(54) PRINTING ASSEMBLY FOR DIRECT AND INDIRECT INKJET PRINTING

(71) Applicant: Océ Holding B.V., Venlo (NL)

(72) Inventors: Pim Du Buf, Venlo (NL); Ke Peng, Venlo (NL); Roy W. N. Evers, Venlo (NL); Daniël H. A. Driessen, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 2 days.

(21) Appl. No.: 15/817,586

(22) Filed: Nov. 20, 2017

(65) Prior Publication Data

US 2018/0147831 A1 May 31, 2018

(30) Foreign Application Priority Data

Nov. 28, 2016 (EP) ..... 16200999

(51) Int. Cl.

| | |
|---|---|
| ***B41J 29/02*** | (2006.01) |
| ***B41J 2/005*** | (2006.01) |
| ***B41J 2/01*** | (2006.01) |
| ***B41J 11/48*** | (2006.01) |

(52) U.S. Cl.

CPC ..... *B41J 2/0057* (2013.01); *B41J 2/01* (2013.01); *B41J 11/485* (2013.01); *B41J 2002/012* (2013.01)

(58) Field of Classification Search

USPC ..... 347/103

See application file for complete search history.

(56) References Cited

U.S. PATENT DOCUMENTS

| | | | | |
|---|---|---|---|---|
| 8,376,498 | B1 | 2/2013 | Mandel et al. | |
| 9,193,209 | B2 * | 11/2015 | Dooley | B41J 2/01 |
| 9,494,884 | B2 * | 11/2016 | Chen | C09D 127/14 |
| 2003/0067528 | A1 * | 4/2003 | Chowdry | B41J 2/04 347/103 |
| 2013/0266803 | A1 * | 10/2013 | Dooley | B32B 27/28 428/339 |
| 2015/0116414 | A1 * | 4/2015 | Eliyahu | C08K 5/5419 347/20 |
| 2015/0258778 | A1 * | 9/2015 | Dooley | B41J 2/0057 347/103 |

(Continued)

OTHER PUBLICATIONS

European Search Report issued in European application No. 16 20 0999, dated May 3, 2017.

*Primary Examiner* — Lam S Nguyen

(74) *Attorney, Agent, or Firm* — Birch, Stewart, Kolasch & Birch, LLP

(57) ABSTRACT

An inkjet printing assembly is configured for direct inkjet printing on a recording medium and for indirect inkjet printing via an intermediate medium. The inkjet printing assembly comprises a transport path for transporting a print medium. Further, a control unit is provided for selecting the print medium, wherein the print medium is may at least be a recording medium or an intermediate medium. An inkjet print station is provided and arranged along the transport path for providing droplets of a liquid on the print medium. A transfer station is provided and configured for transferring the droplets of the liquid from an intermediate medium to a recording medium. A recording medium output station is provided for receiving the printed recording medium.

12 Claims, 2 Drawing Sheets

(56) References Cited

U.S. PATENT DOCUMENTS

| | | | | |
|---|---|---|---|---|
| 2015/0267078 | A1* | 9/2015 | Dooley | C09D 183/04<br>428/447 |
| 2015/0275022 | A1* | 10/2015 | Chen | C09D 127/14<br>347/110 |
| 2015/0315403 | A1 | 11/2015 | Song et al. | |

* cited by examiner

PRINTING ASSEMBLY FOR DIRECT AND INDIRECT INKJET PRINTING

FIELD OF THE INVENTION

The present invention generally pertains to an inkjet printing assembly configured for direct inkjet printing and for indirect inkjet printing and to an intermediate medium for use in such inkjet printing assembly.

BACKGROUND ART

In the field of inkjet printing, two basic inkjet processes are known. First, direct inkjet printing is known. In direct inkjet printing, droplets of ink (or any other liquid) are applied on a recording medium, i.e. the recording medium on which the ink is to be applied to form a resulting printed image. The recording medium is output by the inkjet printing assembly.

Second, indirect inkjet printing is known. Indirect inkjet printing is also known as intermediate inkjet printing. In indirect inkjet printing, in a first step, the ink or other liquid is applied in droplets on an intermediate medium such as a rotating belt, for example. In a second step, the ink on the intermediate medium is transferred to the recording medium. The intermediate medium may be re-used or discarded.

While direct inkjet printing is a simple printing process suitable for applying ink on any kind of substrate as a recording medium, the actual quality and robustness of a printed image varies strongly with the kind of substrate used. Depending on the interaction between substrate and ink, the ink may flow too much or too little or may spread in different directions due to structure of the substrate (e.g. paper fibers). Ink droplets may show coalescence resulting in (color) bleeding, and the like. In practice, an inkjet printing assembly is designed and configured to be used in combination with a small number of kinds of substrates, since it is virtually impossible to provide for a good print quality on every kind of substrate. Further, adherence to a substrate is also very much dependent on the interaction between substrate and ink. So, even if a good image quality is obtained, it may be that the printed ink is (too) easily removed from the substrate again.

In indirect inkjet printing, the above mentioned challenges of direct inkjet printing may be removed by use of a predefined intermediate medium having a priori known properties and interaction with the ink. An image is build on the intermediate medium, wherein the properties of the intermediate medium may even have been designed and configured for optimal image building from droplets of ink expelled from an inkjet print head. In another embodiment, a specific process liquid may be applied to adapt or optimize the interaction of the droplets on the intermediate medium. The image thus build on the intermediate medium is then transferred as a whole to the recording medium, wherein the ink may have been processed prior to the transfer to prevent undesirable effects upon transfer. For example, the ink may have been partially dried, such that only a small amount of solvent (such as water in case of an aqueous ink) is received on the recording medium preventing undesired deformation of the recording medium due to an excessive amount of solvent being absorbed. On the other hand, a transfer yield, i.e. a ratio of an amount of ink actually transferred and an amount of ink present on the intermediate medium, may differ between different recording mediums.

In general, dependent on the application and/or desired printed image properties and/or the kind of recording medium and/or other aspects, the direct inkjet process may be preferred or the indirect inkjet process may be preferred. Moreover, even with the same recording medium, sometimes the direct inkjet transfer may be preferred, while at another time, the indirect inkjet process may be preferred.

It is an object of the present invention to provide for a hybrid inkjet printing system that is enabled to selectively apply the direct inkjet process and the indirect inkjet process.

SUMMARY OF THE INVENTION

The object is achieved in an inkjet printing assembly according to claim 1, wherein the inkjet printing assembly is configured for direct inkjet printing and for indirect inkjet printing. The assembly comprises a transport path for transporting a print medium; a control unit for selecting the print medium, wherein the print medium is selectable from a group comprising a recording medium and an intermediate medium; an inkjet print station arranged along the transport path for providing droplets of a liquid on the print medium; a transfer station, the transfer station being configured for transferring the droplets of the liquid from the print medium to a recording medium, if the print medium is an intermediate medium; and a recording medium output station for receiving the recording medium.

The inkjet printing assembly according to the present invention is provided with a control unit that is configured to select a recording medium as the print medium, i.e. the medium on which droplets are provided, or to select an intermediate medium as the print medium. The control unit may perform such selection based on a direct input from a user or may perform the selection based on desired image quality aspects or other print job settings. For example, a document to be printed may contain pages of only black text and other pages comprising color images. The pages with only black text may be selected to be printed directly on the recording medium, while the color images may be selected to be printed on the intermediate medium, after which the pages with the color images are transferred to a same type of recording medium as the recording medium of the black text only pages. Thus, the inkjet printing assembly configured for both direct and indirect inkjet printing has an increased media range and versatility.

In an embodiment, the transport path is formed by a rotating endless surface, wherein the endless surface is configured for transporting the print medium. A rotating endless surface is commonly provided by a surface of a rotating drum or by a surface of a rotating belt arranged around two or more rollers. The print medium may be arranged on the surface and be transported along the inkjet print station for receiving droplets of liquid, such as ink.

In a particular embodiment, the endless surface is configured to function as the intermediate medium. In such particular embodiment, a recording medium may be arranged on the endless surface to be printed on directly or droplets are provided on the endless surface and in the transfer station transferred to the recording medium.

In an embodiment, the print medium is a sheet. The inkjet printing assembly according to the invention is in such embodiment provided with at least two print medium input stations, a first print medium input station for providing a recording medium as a print medium and a second print medium input station for providing an intermediate medium as a print medium. Both print medium input stations are configured to supply the print medium to the transport path and both are operatively coupled to the control unit such that the control unit is enabled to select the print medium by instructing either the first or the second print medium input station to release and supply a print medium.

In an embodiment, the inkjet printing assembly according to the present invention is further provided with a treatment station upstream of the inkjet printing station for treating the print medium prior to receiving the droplets of liquid (ink) thereon. The treatment may include a drying treatment, an electrostatic or plasma treatment and/or application of a process liquid. Such a process liquid may be used for controlling wetting properties or adhesion properties or any other properties relating to the interaction between the print medium and the droplets of the liquid. The treatment may be directed at the interaction between the liquid droplets and the intermediate medium during indirect inkjet printing, but may as well be directed at the interaction with the recording medium during direct inkjet printing. Moreover, the treatment station may comprise multiple treatment units such to select and apply a suitable treatment depending on the print medium and other aspects of the inkjet printing process applied for the relevant print job and/or image to be printed.

In an embodiment, the inkjet printing assembly further comprises a return transport path extending between the transfer station and the transport path, the return transport path being configured to return an intermediate medium to the transport path for reusing the intermediate medium. Any intermediate medium is preferably re-used to reduce waste. A return transport path enables and allows a used intermediate medium to be returned to an upstream location of the transport path. In particular in an embodiment wherein the intermediate medium is a sheet, the intermediate medium may be transported to the print medium input station holding intermediate medium sheets.

In an embodiment, the inkjet printing assembly further comprises a cleaning station downstream of the transfer station, wherein the cleaning station is configured for cleaning the intermediate medium. In practice, some liquid, ink or process liquid or any other liquid, may remain on the intermediate medium after transfer of the printed image from the intermediate medium to the recording medium. For re-use of the intermediate medium for printing an image without contamination from an earlier image, the intermediate medium is preferably cleaned and thus any contaminants are removed before re-use.

In an embodiment, the intermediate medium comprises a laminar structure of at least three layers. A top layer has suitable properties for interaction with a liquid to be supplied thereon in the inkjet printing assembly; a bottom layer has a high tensile strength for strengthening the intermediate medium; and a base layer interposed between the top layer and the bottom layer, has suitable properties for conformity to the inkjet printing assembly. Such a laminar structure provides for suitable design freedom to adapt the intermediate medium to the conditions and properties of the inkjet printing assembly and any interactions with the droplets of the liquid ejected by the inkjet print head. For example, the top layer of the intermediate medium may comprise a material selected to provide for sufficient spreading and release of the liquid. In particular, the material of the top layer may comprise at least one of a fluorinated polymer and a silicone rubber. The bottom layer of the intermediate medium may comprise a high tensile strength carrier; in particular it may comprise at least one of nylon, polyimide, polyester or polyethylene terephtalate.

In an embodiment, the intermediate medium may further comprise a reinforcement, wherein the reinforcement is arranged at at least a part of a circumference of the intermediate medium for preventing abrasion of an edge of the intermediate medium. In view of the layered structure of the intermediate medium and in view of an intended repeated use, the edge of the intermediate medium may at least partly be protected against abrasion.

In an aspect, the present invention is also directed at a method for direct inkjet printing and for indirect inkjet printing on a recording medium. The method comprises the steps of selecting a print medium, wherein the print medium is selectable from a group comprising a recording medium and an intermediate medium; transporting the print medium to an inkjet print station for providing droplets of liquid on the print medium; after providing the droplets, transporting the print medium to a transfer station; at the transfer station, transferring the droplets of liquid from the print medium to a recording medium, if the print medium is an intermediate medium; transporting the recording medium to a recording medium output station.

Further, it is noted that the above-mentioned intermediate medium may be used in combination with other printing assemblies as well and is therefore not limited to a combination with the printing assembly according to the present invention. For example, the intermediate medium may be used in an inkjet printing assembly only configured for indirect inkjet printing.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1:
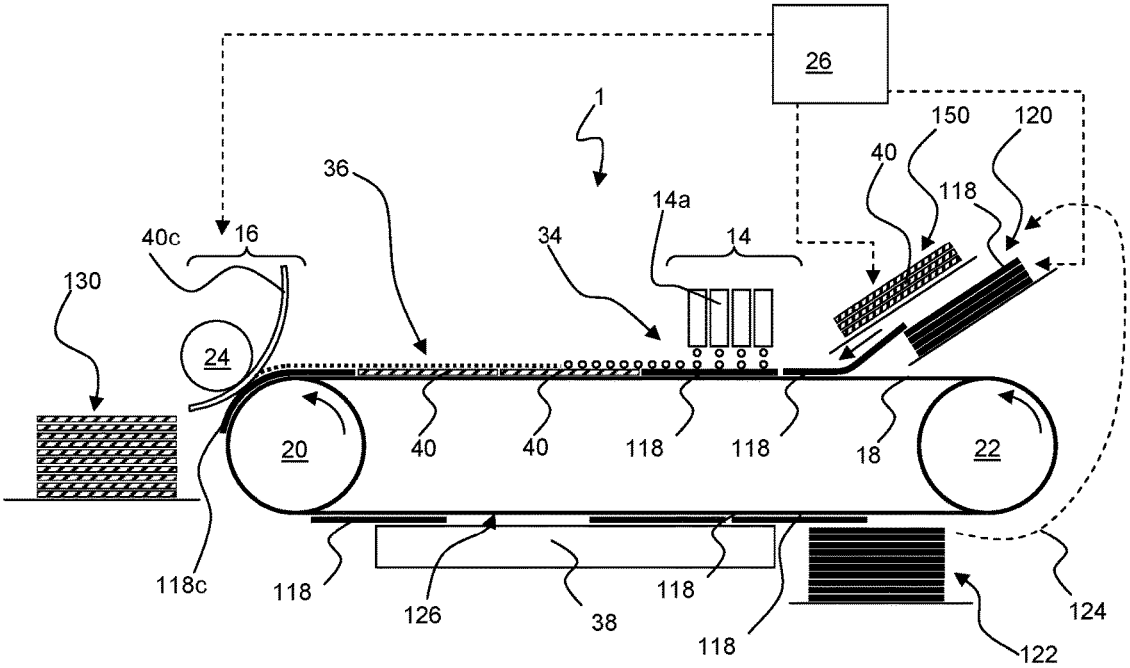
FIG. 1 schematically illustrates a first embodiment of the present invention.

The present invention will now be described with reference to the accompanying drawings, wherein the same reference numerals have been used to identify the same or similar elements throughout the several views.

In FIG. 1, an embodiment of an inkjet printing assembly 1 according to the present invention is shown, wherein a transport path is provided by an endless belt 18 rotating around two rollers 20, 22. The transport path passes along an inkjet print station 14 comprising an inkjet print head 14*a*. The inkjet print station 14 may be configured to eject droplets 34 of ink of a single color, in particular black. In other embodiments, the inkjet print station may be configured to provide droplets of ink of a number of colors, in particular four commonly used process colors: cyan, magenta, yellow and black (also referred to as CMYK). Also other kind of liquids may be used such as varnish, metallic colored inks, white ink, and the like.

As known in the art, the inkjet print head 14*a* may be constructed in many ways. In some embodiments, an inkjet print head 14*a* may be configured and arranged to eject droplets 34 of ink in a single color and, if multiple colors are desired, multiple inkjet print heads 14*a* may be provided in the inkjet print station, while in other embodiments, a single inkjet print head 14*a* may be constructed and configured to expel droplets 34 of ink in multiple colors.

The droplets 34 of ink provided in the inkjet print station 14 may form a print image 36 which proceeds along the transport path to a transfer station 16. As elucidated hereinbelow in more detail, at the transfer station 16, a print image 36 may be transferred from an intermediate medium 118 to a recording medium 40. Thereto, for example, a pressure roller 24 may be provided for exerting a pressure on the intermediate medium 118 and recording medium 40 such to transfer the ink of the print image 36 from the intermediate medium 118 to the recording medium 40.

With respect to a print medium on which the droplets 34 of ink are provided at the inkjet print station 14, the print medium may be a recording medium 40 or an intermediate medium 118. Providing the droplets 34 directly on the recording medium 40 is herein referred to as a direct inkjet printing process, since the recording medium 40 is output to the user, while providing the droplets 34 on the intermediate medium 118 is referred to as an indirect inkjet printing process, since the ink forming the print image 36 is transferred to a recording medium 40 in the transfer station 16. The intermediate medium 118 may be re-used.

Using an intermediate medium 118 may be preferred, since the dependency on recording medium properties for obtaining a good image quality is less compared to a direct inkjet print process. The spreading, drying and other processes involved in inkjet printing may be better controlled having a predefined intermediate medium 118 having known and possibly adapted and designed properties. Thus, the image forming processes involved may be tuned and optimized using an indirect printing process, although not every type of recording medium 40 is suitable for a transfer of the ink from an intermediate medium 118. Therefore, an inkjet printing assembly 1 according to the present invention is configured to be able to perform both indirect and direct inkjet printing.

In particular, in the embodiment shown in FIG. 1, a first input station 120 holds a number of intermediate medium sheets 118 and a second input station 150 holds a number of recording medium sheets 40. A control unit 26 is operatively coupled to the first input station 120 and the second input station 150. The control unit 26 is configured to control both input stations 120, 150 such that one of both releases a sheet into the transport path, i.e. to a surface of the endless belt 18. Preferably, the control unit 26 is also operatively coupled to the transfer station 16 such that the transfer station 16 may be operated in correspondence to a need to transfer a print image 36 from an intermediate medium 118 to a recording medium 40 or to let a printed recording medium 40 pass. The print medium thus supplied from one of the input stations 120, 150 is transported to the downstream inkjet print station 14, where droplets 34 of ink are provided image-wise to form the print image 36.

If the print medium is a recording medium 40 originating from the second input station 150, the print medium may pass the transfer station 16 without any particular processing and may then proceed to a downstream recording medium output station 130. If the print medium is an intermediate medium 118 originating from the first print station 120, the print medium proceeds to the transfer station 16, while a recording medium sheet 40*c* is supplied from a second transport path to arrive in synchronization with the intermediate medium 118*c*. In the illustrated embodiment, the recording medium sheet 40*c* and the intermediate medium sheet 118*c* are pressed against each other by the pressure roller 24 and the print image 36 is transferred from the intermediate medium sheet 118*c* to the recording medium sheet 40*c*. Of course, other transfer mechanisms and/or additional measures may be applicable. For example, heat may be applied before and/or during the intermediate medium 118*c* and the recording medium 40*c* being pressed against each other. A skilled person is deemed aware of any particular measures and mechanisms for transferring the ink of the print image 36 from the intermediate medium 118*c* to the recording medium 40*c*.

As mentioned above, the control unit 26 may be configured to control the operation of the transfer station 16. For example, the control unit 26 may control the pressure roller 24 to open or close the pressure nip between the pressure roller 24 and the endless belt 18 depending on the need to press the recording medium 40*c* against the intermediate medium 118*c* or to let a printed recording medium 40 pass towards the medium output station 130. Although not illustrated in detail, the control unit 26 may also be configured to control the second transport path for supplying the recording medium 40*c* in synchronization with the corresponding intermediate medium 118*c* to the transfer station 16.

Downstream of the transfer station 16, recording mediums 40 are output to the medium output station 130 which may be any kind of medium handling station. It may be a simple output tray as shown or may be a stacking device, a booklet maker, a sorter, a folder or any other well known medium handling devices.

The intermediate mediums 118 are not output to the medium output station 130 and are thus separated from the recording mediums 40. For example, as shown in FIG. 1, the intermediate medium 118 may be held on the endless belt 18 and transported to an inline cleaning station 38 for cleaning the intermediate medium 118 to prevent pollution of a subsequent image printed with the same intermediate medium 118, presuming the intermediate medium 118 is re-used. Of course, the present invention is not particularly limited to an inline cleaning station 38. An offline cleaning station may be used instead or, if the transfer of the ink of the print image 36 is sufficient, a cleaning station 38 may even be omitted.

Note that an empty location 126 on the endless belt 18 between the intermediate mediums 118 at the cleaning station 38 may correspond to a location where a recording medium 40 was positioned, which has been send to the medium output station 130 upstream of the cleaning station 38.

The cleaning station 38 may include a detection system for detecting properties of the intermediate medium 118 in order to determine the suitability of the intermediate medium 118 for re-use. If the intermediate medium 118 is detected to be damaged or worn-out, the cleaning station 38 may be configured to separate the unusable intermediate mediums 118 and the re-usable intermediate mediums 118.

In the illustrated embodiment of FIG. 1, the used and preferably cleaned intermediate mediums 118 are collected in an intermediate sheet receiving station 122. From the intermediate medium receiving station 122, the intermediate mediums 118 may be further transported to the first medium input station 120, either manually or automatically, in accordance with the dashed arrow 124. In an embodiment, the intermediate medium receiving station 122 may be omitted and intermediate mediums 118 may be returned directly to the first medium input station 120, for example.

While the embodiment of FIG. 1 uses an intermediate medium 118 in a sheet form, the present invention may use a surface of the endless belt 18 as an intermediate medium instead. In such embodiment, a single medium input station 150 may be provided for supplying a recording medium 40 on said surface. If no sheet of recording medium 40 is supplied, the inkjet print station 14 may apply droplets 34 of ink on the surface of the endless belt 18 and transfer the print image 36 from said surface to the recording medium 40*c* at the transfer station 16.

Figure 2:
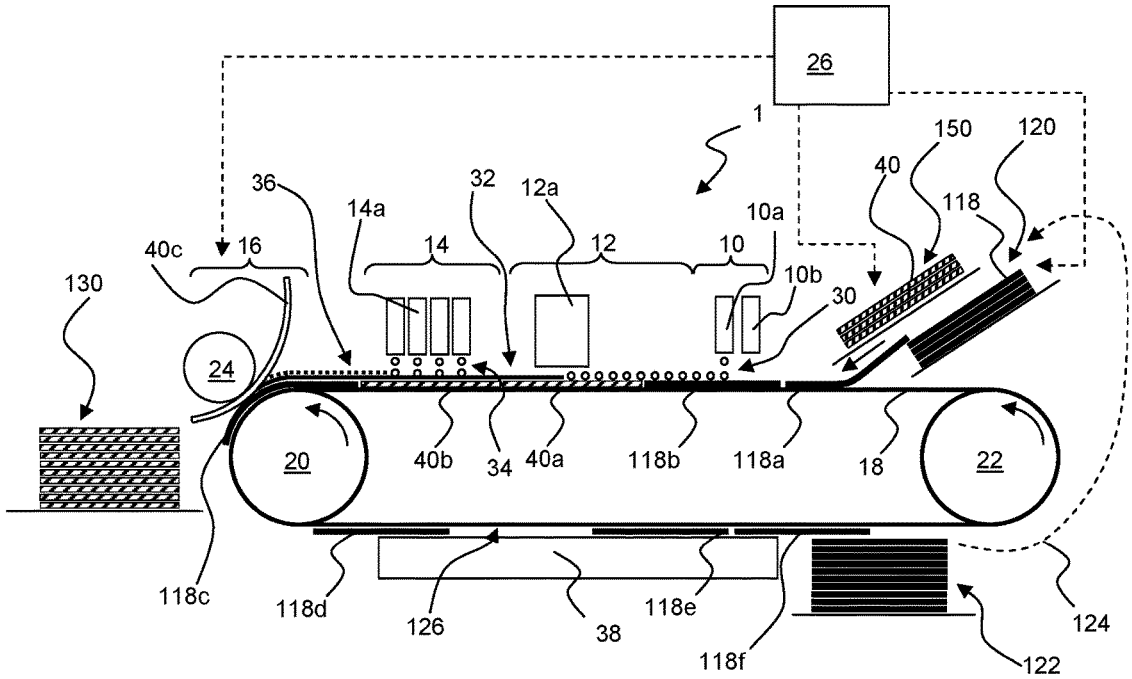
FIG. 2 schematically illustrates a second embodiment of the present invention.

FIG. 2 illustrates a further embodiment, wherein the embodiment is provided with a first inkjet print station 10, a treatment station 12, a second inkjet print station 14 and a transfer station 16. The second inkjet print station corresponds to the inkjet print station 14 of the embodiment of FIG. 1 and is provided for generating the print image 36, which is optionally transferred in the transfer station 16 as described in relation to FIG. 1. Apart from the additional first inkjet station 10 and the treatment station 12, the embodiment of FIG. 2 is similar to the embodiment of FIG. 1 and detailed description of the medium handling is therefore omitted by reference to the description relating to FIG. 1.

The first inkjet print station 10 is provided for applying a process liquid 30, preferably image-wise. Image-wise is intended to mean that the process liquid may be applied locally in any two-dimensional array of locations (pixels) to form a kind of image of the process liquid. Image-wise does not imply any direct and necessary relation to the print image 36. Although in common practice, the image applied by the first print station 10 is intended to control the image formation at and after the second inkjet station 14, the process liquid may be applied at locations where no print image becomes visible, but for example to control a local gloss of the recording medium 40 outside an area of the print image 36.

The first print station 10 may comprise a single inkjet print head 10*a* adapted and configured to apply a single kind of process liquid 30. In another embodiment, multiple kinds of process liquids 30 may be available and applied using multiple inkjet print heads 10*a*, 10*b*.

The process liquid 30 may preferably be adapted to control an ink droplet behavior of the ink droplets 34 applied at the second inkjet print station 14, in particular, but not limited to, when applied on an intermediate medium 118.

Further, the treatment station 12 comprises at least one treatment device 12*a* for treating the process liquid 30 as applied by the first inkjet print station 10, where desired. For example, a process liquid 30 applied on an intermediate medium 118 may be or may comprise a release agent such to ease or improve the transfer of the ink droplets 34 from the intermediate medium 118 at the transfer station 16. However, such release agent tends to have a large contact angle with the intermediate medium 118 and thus tends to form beads. Such beads may be undesirable and therefore the treatment device 12*a* may be configured to flatten the beads in order to form a thin layer of process liquid 30. In order to fixate such layer, i.e. to prevent that the process liquid 30 forms beads again before reaching the second inkjet print station 14, the treatment station 12 may further comprise a curing device, for example a heating element for evaporating a solvent, to increase a viscosity. Many other kinds of treatment of the process liquid 30 are contemplated, but are not described in detail herein.

In any case, the addition of the first inkjet print station 10 and the treatment station 12 increases a working latitude of the printing assembly 1, since the interactions between the large range of kinds of print medium and the ink 34 is better controlled by the use of the process liquid 30.

Figure 3:
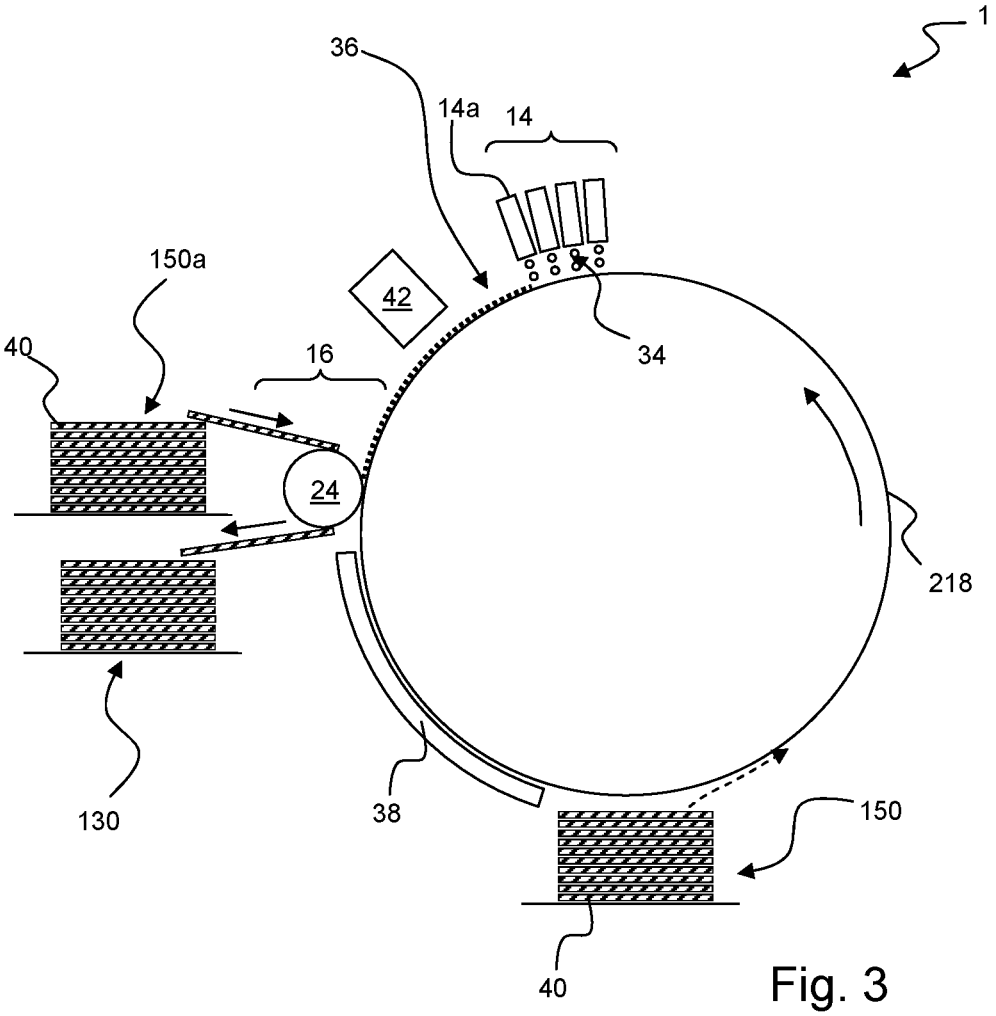
FIG. 3 schematically illustrates a third embodiment of the present invention.

FIG. 3 illustrates another embodiment, wherein the endless belt of the embodiments of FIGS. 1 and 2 is replaced by a rotatable drum 218. The rotatable drum 218 may have a specifically treated surface and/or a specifically selected material layer to be used as a intermediate medium. In another embodiment, the intermediate medium sheets as shown in FIGS. 1 and 2 may be used instead. In the illustrated embodiment, only a medium input station 150 is provided for supplying a recording medium 40 to the surface of the rotatable drum 218 corresponding to dashed arrow 152.

The illustrated embodiment is provided with a single inkjet print station 14 corresponding to the embodiment of FIG. 1, although multiple inkjet print stations and/or an additional treatment station corresponding to the embodiment of FIG. 2 may be added. Further, the illustrated embodiment is provided with a post-treatment device 42, which may be used for treatment of the print image 36. For example, the ink of the print image 36 may be dried by heating, air blowing and the like to prevent that an excess amount of solvent (usually water) is absorbed in the recording medium 40 upon transfer at the transfer station 16. Such use of a post-treatment device 42 may thus be advantageous for applying print images 36 which require a large amount of ink by use of an indirect inkjet print process in order to prevent deformation of the recording medium 40 due to such an excess amount of solvent being absorbed.

Another recording medium input station 150*a* is provided for supplying a recording medium 40 for indirect inkjet printing thereon. The other recording medium input station 150*a* supplies the recording medium 40 directly to the transfer station 16 in synchronization with the print image 36 on the intermediate medium 218.

Figure 4:
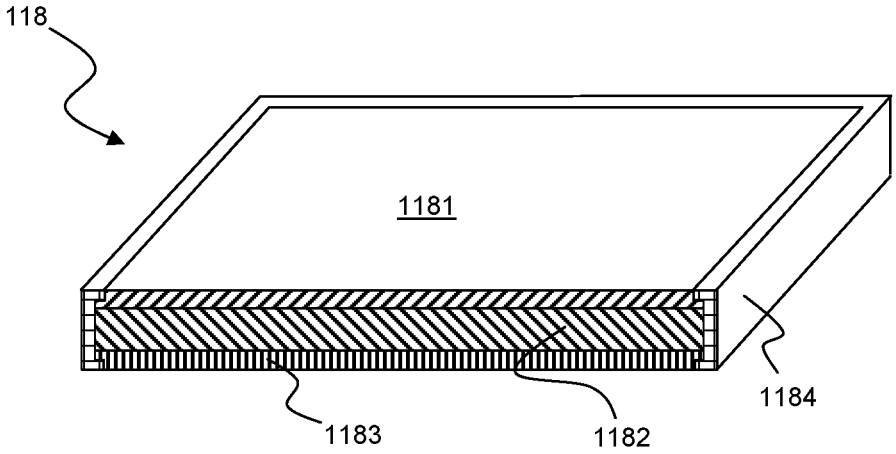
FIG. 4 schematically shows a perspective view of an intermediate medium, partly in cross-section, according to the present invention.

FIG. 4 illustrates an embodiment of an intermediate medium 118 adapted for use in the inkjet print assembly 1 according to the present invention. The illustrated intermediate medium 118 comprises a laminar structure of three layers: a top layer 1181 having suitable properties for interaction with a liquid to be supplied thereon in the inkjet printing assembly; a bottom layer 1183 having a high tensile strength for strengthening the intermediate medium 118; and a base layer 1182 interposed between the top layer 1181 and the bottom layer 1183. The base layer 1182 has suitable properties for conformity to the inkjet printing assembly, such as thickness, stiffness, and other properties apparent to those skilled in the art.

In particular, the top layer 1181 of the intermediate medium 118 may comprise a material selected to provide for sufficient spreading and release of the process liquid ejected by the inkjet print heads 10*a* of the first inkjet print station 10 as illustrated in the embodiment of FIG. 2. In another embodiment, the top layer 1181 may be designed to easily release any ink forming the print image 36. In particular, the material of the top layer may comprise at least one of a fluorinated polymer and a silicone rubber.

The bottom layer 1183 of the intermediate medium 118 may comprise a high tensile strength carrier. Since the bottom layer 1183 may experience most friction during transport through the inkjet printing assembly as compared to the top layer 1181 and the base layer 1182, the bottom layer 1183 may be designed to have a low friction to reduce wear and/or may be designed to have little wear despite the friction. In particular, the bottom layer 1183 may comprise at least one of nylon, polyimide, polyester or polyethylene terephtalate.

In the illustrated embodiment, the intermediate medium 118 further comprises a reinforcement 1184. The reinforcement 1184 is arranged at a circumference of the intermediate medium 118 for preventing abrasion of an edge of the top layer 1181, the base layer 1182 and/or the bottom layer 1183. In view of the layered structure of the intermediate medium 118 and in view of an intended repeated use, the edge of the intermediate medium 118 may become abraded during use, which could lead to early disposal of such an abraded intermediate medium 118. In order to extend the lifetime of the intermediate medium 118 to a maximum, the reinforcement is provided to prevent the abrasion of the edge.

It is noted that it is not essential for the reinforcement to be provided at the whole circumference. For example, only the corners and/or a leading edge may be provided with the reinforcement, since the corners and the leading edge may be deemed to experience the most potentially abrading contact in the inkjet printing assembly.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term "plurality" or "multiple", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An inkjet printing assembly configured for direct inkjet printing and for indirect inkjet printing, the assembly comprising:

a transport path for transporting a print medium;

a control unit for selecting the print medium, wherein the print medium is selectable from a group comprising a recording medium and an intermediate medium;

an inkjet print station arranged along the transport path for providing droplets of a liquid on the print medium;

a transfer station, the transfer station being configured for transferring the droplets of the liquid from the print medium to a recording medium, if the print medium is an intermediate medium; and a recording medium output station for receiving the recording medium, wherein the inkjet printing assembly is further configured to perform both indirect and direct inkjet printing, and wherein the inkjet print station is configured to provide droplets of ink on both the recording medium and the intermediate medium.

2. The inkjet printing assembly according to claim 1, wherein the transport path is formed by a rotating endless surface, wherein the endless surface is configured for transporting the print medium.

3. The inkjet printing assembly according to claim 2, wherein the endless surface is further configured as the intermediate medium.

4. The inkjet printing assembly according to claim 1, wherein the print medium is a sheet and the inkjet printing assembly further comprises a first print medium input station for supplying an intermediate sheet to the transport path and a second print medium input station for supplying a recording sheet to the transport path, wherein the control unit is operatively coupled to the first and the second input station for selecting the print medium.

5. The inkjet printing assembly according to claim 1, wherein the inkjet printing assembly further comprises a treatment station upstream of the inkjet printing station for treating the print medium prior to receiving the droplets of the liquid.

6. The inkjet printing assembly according to claim 1, wherein the inkjet printing assembly further comprises a return transport path extending between the transfer station and the transport path, the return transport path being configured to return an intermediate medium to the transport path for reusing the intermediate medium.

7. The inkjet printing assembly according to claim 1, wherein the inkjet printing assembly further comprises a cleaning station downstream of the transfer station, wherein the cleaning station is configured for cleaning the intermediate medium.

8. The inkjet printing assembly according to claim 1, wherein the intermediate medium comprises a laminar structure of at least three layers including:

a top layer having suitable properties for interaction with a liquid to be supplied thereon in the inkjet printing assembly;

a bottom layer having a high tensile strength for strengthening the intermediate medium; and a base layer interposed between the top layer and the bottom layer, the base layer having suitable properties for conformity to the inkjet printing assembly.

9. The inkjet printing assembly according to claim 8, wherein the top layer of the intermediate medium comprises a material selected to provide for sufficient spreading and release of the liquid, the material in particular comprising at least one of a fluorinated polymer and a silicone rubber.

10. The inkjet printing assembly according to claim 8, wherein the bottom layer of the intermediate medium comprises a high tensile strength carrier, the carrier in particular comprising at least one of nylon, polyimide, polyester or polyethylene terephtalate.

11. The inkjet printing assembly according to claim 8, wherein the intermediate medium comprises a reinforcement, wherein the reinforcement is arranged at at least a part of a circumference of the intermediate medium for preventing abrasion of an edge of the intermediate medium.

12. A method for direct inkjet printing and for indirect inkjet printing on a recording medium using the printer according to claim 1, wherein the method comprises selecting a print medium, wherein the print medium is selectable from a group comprising a recording medium and an intermediate medium;

transporting the print medium to the inkjet print station for providing droplets of liquid on the print medium;

after providing the droplets, transporting the print medium to the transfer station;

at the transfer station, transferring the droplets of liquid from the print medium to the recording medium, if the print medium is the intermediate medium; and transporting the recording medium to a recording medium output station.

* * * * *